US012753682B1

(12) United States Patent
Barker et al.

(10) Patent No.: US 12,753,682 B1
(45) Date of Patent: Oct. 6, 2026

(54) ENERGY RELEASE IN ENERGETIC PERFORATING DEVICES

(71) Applicant: Halliburton Energy Services, Inc., Houston, TX (US)

(72) Inventors: James Marshall Barker, Alvarado, TX (US); Jason Paul Metzger, Alvarado, TX (US); Christopher C. Hoelscher, Alvarado, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/215,137

(22) Filed: May 21, 2025

(51) Int. Cl.
*E21B 43/119* (2006.01)
*E21B 43/116* (2006.01)

(52) U.S. Cl.
CPC ..... *E21B 43/119* (2013.01); *E21B 43/116* (2013.01)

(58) Field of Classification Search
CPC .... E21B 43/116; E21B 43/119; E21B 43/117; F42B 1/00–04
See application file for complete search history.

(56) References Cited

U.S. PATENT DOCUMENTS

| | | | | |
|---|---|---|---|---|
| 4,539,909 | A | 9/1985 | Day et al. | |
| 4,703,986 | A | 11/1987 | McCormick | |
| 4,718,345 | A | 1/1988 | Yunan | |
| 4,778,404 | A | 10/1988 | Pass | |
| 5,201,598 | A | 4/1993 | Tehan | |
| 5,775,419 | A | 7/1998 | Gramlich | |
| 6,059,595 | A | 5/2000 | Lacrouts-Cazenave | |
| 6,112,813 | A | 9/2000 | Head | |
| 6,223,656 | B1 * | 5/2001 | Glenn | F42B 3/08 102/306 |
| 6,783,405 | B1 | 8/2004 | Yen | |
| 7,121,340 | B2 | 10/2006 | Grove et al. | |
| 7,197,985 | B2 | 4/2007 | Markel et al. | |
| 8,347,963 | B2 | 1/2013 | Johnson et al. | |
| 8,555,764 | B2 | 10/2013 | Le et al. | |
| 8,939,802 | B2 | 1/2015 | Hara et al. | |

(Continued)

FOREIGN PATENT DOCUMENTS

| | | | |
|---|---|---|---|
| DE | 102021108869 | A1 | 11/2021 |
| WO | 2016118179 | A1 | 7/2016 |

(Continued)

OTHER PUBLICATIONS

SPE-130477-ms Effect of Shaped Charge Casing Material (Year: 2010).*

(Continued)

*Primary Examiner* — George S Gray
(74) *Attorney, Agent, or Firm* — Benjamin Ford; C. Tumey Law Group PLLC

(57) ABSTRACT

Methods and apparatus managing energy release in energetic perforating devices, such as perforating guns, for example. In some embodiments, the methods comprise deploying the energetic perforating device having an explosive into a wellbore, removing air from an interior volume of the energetic perforating device, placing the energetic perforating device into the wellbore, and forming a perforation in the wellbore with the energetic perforating device by detonating the explosive, wherein the removing of the air limits reaction of the explosive.

20 Claims, 8 Drawing Sheets

(56) References Cited

U.S. PATENT DOCUMENTS

| | | | | |
|---|---|---|---|---|
| 8,978,749 | B2 | 3/2015 | Rodgers et al. | |
| 9,523,265 | B2 | 12/2016 | Upchurch et al. | |
| 9,605,937 | B2 | 3/2017 | Eitschberger et al. | |
| 10,060,234 | B2 | 8/2018 | Robey et al. | |
| 10,365,078 | B2 | 7/2019 | Eitschberger | |
| 10,415,353 | B2 | 9/2019 | Robey et al. | |
| 10,669,821 | B2 | 6/2020 | Knight et al. | |
| 11,098,563 | B1 | 8/2021 | Ludwig | |
| 11,299,967 | B2 | 4/2022 | Bradley et al. | |
| 11,313,208 | B2 | 4/2022 | Hoelscher et al. | |
| 11,359,468 | B2 | 6/2022 | Roberts et al. | |
| 11,547,976 | B2 | 1/2023 | Ledwon et al. | |
| 11,608,720 | B2 | 3/2023 | Preiss et al. | |
| 11,674,370 | B2 | 6/2023 | Shelton et al. | |
| 11,906,279 | B2 | 2/2024 | Eitschberger | |
| 12,158,060 | B1 | 12/2024 | Grove et al. | |
| 12,264,561 | B2 | 4/2025 | Roberts et al. | |
| 12,312,923 | B2 | 5/2025 | Cook et al. | |
| 12,320,203 | B2 | 6/2025 | Roberts et al. | |
| 12,352,551 | B2 | 7/2025 | Roberts et al. | |
| 2003/0037692 | A1* | 2/2003 | Liu | F42B 1/032 102/301 |
| 2003/0047313 | A1 | 3/2003 | Wehunt, Jr. | |
| 2003/0089498 | A1* | 5/2003 | Johnson | E21B 37/08 166/55 |
| 2004/0216633 | A1 | 11/2004 | Kash | |
| 2004/0216866 | A1 | 11/2004 | Barlow et al. | |
| 2004/0231840 | A1* | 11/2004 | Ratanasirigulchai | E21B 37/08 166/259 |
| 2007/0084336 | A1 | 4/2007 | Neves | |
| 2007/0095529 | A1 | 5/2007 | Bond et al. | |
| 2007/0107589 | A1 | 5/2007 | Rospek et al. | |
| 2007/0119327 | A1 | 5/2007 | Myers, Jr. et al. | |
| 2009/0183916 | A1* | 7/2009 | Pratt | E21B 43/117 175/2 |
| 2010/0065274 | A1 | 3/2010 | Haney et al. | |
| 2010/0227514 | A1 | 9/2010 | Rikimaru et al. | |
| 2010/0276136 | A1 | 11/2010 | Evans et al. | |
| 2011/0042089 | A1 | 2/2011 | Chang et al. | |
| 2011/0127045 | A1 | 6/2011 | Spence et al. | |
| 2012/0181026 | A1* | 7/2012 | Le | E21B 43/1195 166/55 |
| 2014/0065351 | A1 | 3/2014 | Cordner et al. | |
| 2014/0260591 | A1 | 9/2014 | Rodgers et al. | |
| 2015/0226533 | A1 | 8/2015 | Grattan | |
| 2015/0337629 | A1* | 11/2015 | Zhang | E21B 43/25 166/250.01 |
| 2016/0003600 | A1 | 1/2016 | Glenn et al. | |
| 2016/0153267 | A1 | 6/2016 | Walker et al. | |
| 2016/0356132 | A1 | 12/2016 | Burmeister et al. | |
| 2016/0376879 | A1 | 12/2016 | Goodman et al. | |
| 2017/0241244 | A1 | 8/2017 | Barker et al. | |
| 2017/0275974 | A1 | 9/2017 | Von Kaenel et al. | |
| 2018/0112500 | A1 | 4/2018 | Collins et al. | |
| 2018/0291715 | A1 | 10/2018 | Barker | |
| 2020/0024935 | A1 | 1/2020 | Eitschberger et al. | |
| 2020/0048996 | A1 | 2/2020 | Anthony et al. | |
| 2020/0088013 | A1 | 3/2020 | Grove et al. | |
| 2020/0200516 | A1 | 6/2020 | Zemla et al. | |
| 2020/0208485 | A1 | 7/2020 | Hoelscher et al. | |
| 2020/0248535 | A1 | 8/2020 | Goyeneche | |
| 2020/0256166 | A1 | 8/2020 | Knight et al. | |
| 2020/0284125 | A1 | 9/2020 | Robey et al. | |
| 2020/0392819 | A1 | 12/2020 | Robey et al. | |
| 2020/0392820 | A1 | 12/2020 | Robey et al. | |
| 2021/0032963 | A1 | 2/2021 | Robey et al. | |
| 2021/0172298 | A1 | 6/2021 | Knight et al. | |
| 2021/0222525 | A1 | 7/2021 | Dyess et al. | |
| 2021/0277752 | A1 | 9/2021 | Eitschberger | |
| 2021/0332676 | A1 | 10/2021 | Grove et al. | |
| 2021/0332677 | A1 | 10/2021 | Grove et al. | |
| 2021/0332678 | A1 | 10/2021 | Anthony et al. | |
| 2021/0396103 | A1 | 12/2021 | MacGillivray et al. | |
| 2022/0010660 | A1 | 1/2022 | Dyess et al. | |
| 2022/0018226 | A1 | 1/2022 | Wells et al. | |
| 2022/0018227 | A1 | 1/2022 | Kash et al. | |
| 2022/0074288 | A1 | 3/2022 | Barker et al. | |
| 2022/0099423 | A1 | 3/2022 | Sullivan et al. | |
| 2022/0127935 | A1 | 4/2022 | Grove et al. | |
| 2022/0145732 | A1 | 5/2022 | Anthony et al. | |
| 2022/0282598 | A1 | 9/2022 | Luo et al. | |
| 2022/0282600 | A1 | 9/2022 | Dyess et al. | |
| 2022/0364444 | A1 | 11/2022 | Metzger et al. | |
| 2023/0069950 | A1 | 3/2023 | Badii et al. | |
| 2023/0184066 | A1 | 6/2023 | Hoelscher et al. | |
| 2023/0212927 | A1 | 7/2023 | Cook et al. | |
| 2023/0364673 | A1 | 11/2023 | Hoelscher et al. | |
| 2024/0210151 | A1 | 6/2024 | Roberts et al. | |
| 2025/0101839 | A1 | 3/2025 | Hoelscher | |

FOREIGN PATENT DOCUMENTS

| | | | |
|---|---|---|---|
| WO | 2021198145 | A1 | 10/2021 |
| WO | 2022184731 | A1 | 9/2022 |

OTHER PUBLICATIONS

International Search Report and Written Opinion for International Patent Application No. PCT/US2023/083902 dated Apr. 18, 2024. PDF file. 10 pages.

International Search Report and Written Opinion for International Patent Application No. PCT/US2023/080589 dated Mar. 19, 2024. PDF file. 10 pages.

International Search Report and Written Opinion for International Patent Application No. PCT/US2023/080587 dated Mar. 19, 2024. PDF file. 8 pages.

International Search Report and Written Opinion for International Patent Application No. PCT/US2023/076255 dated Jun. 14, 2024. PDF file. 12 pages.

Halliburton. Velocity Perforating System Improved Surface Efficiency and Downhole Reliability. Halliburton, 2017. H012737 12/17. PDF file. 1 page.

Halliburton. Velocity Aligned Gun System. Halliburton, 2023. H014094 02/23. PDF file. 2 pages.

Halliburton. Velocity Revolve Gun System. Halliburton, 2023. H014095 02/23. PDF file. 2 pages.

Halliburton, Velocity Perforating System Plug and Play Guns For Pumpdown Operations, Halliburton, 2021. H012844WP 03/21. PDF file. 8 pages.

International Search Report and Written Opinion for International Patent Application No. PCT/US2025/032331 dated Feb. 5, 2026. PDF file. 8 pages.

* cited by examiner

ENERGY RELEASE IN ENERGETIC PERFORATING DEVICES

BACKGROUND

After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore. To produce fluids into the casing string, hydraulic openings or perforations are made through the casing string, the cement sheath, and a short distance into the formation.

Typically, these perforations are created by a perforator. A series of shaped charges are held in a hollow steel carrier. The perforator is connected along a tool string that is lowered into the cased wellbore by a tubing string, wireline, slick line, coiled tubing, or other conveyance. Once the perforator is properly positioned in the wellbore adjacent to the formation to be perforated, the shaped charges may be detonated, thereby creating perforations through the hollow steel carrier and the desired hydraulic openings through the casing and cement sheath into the formation.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
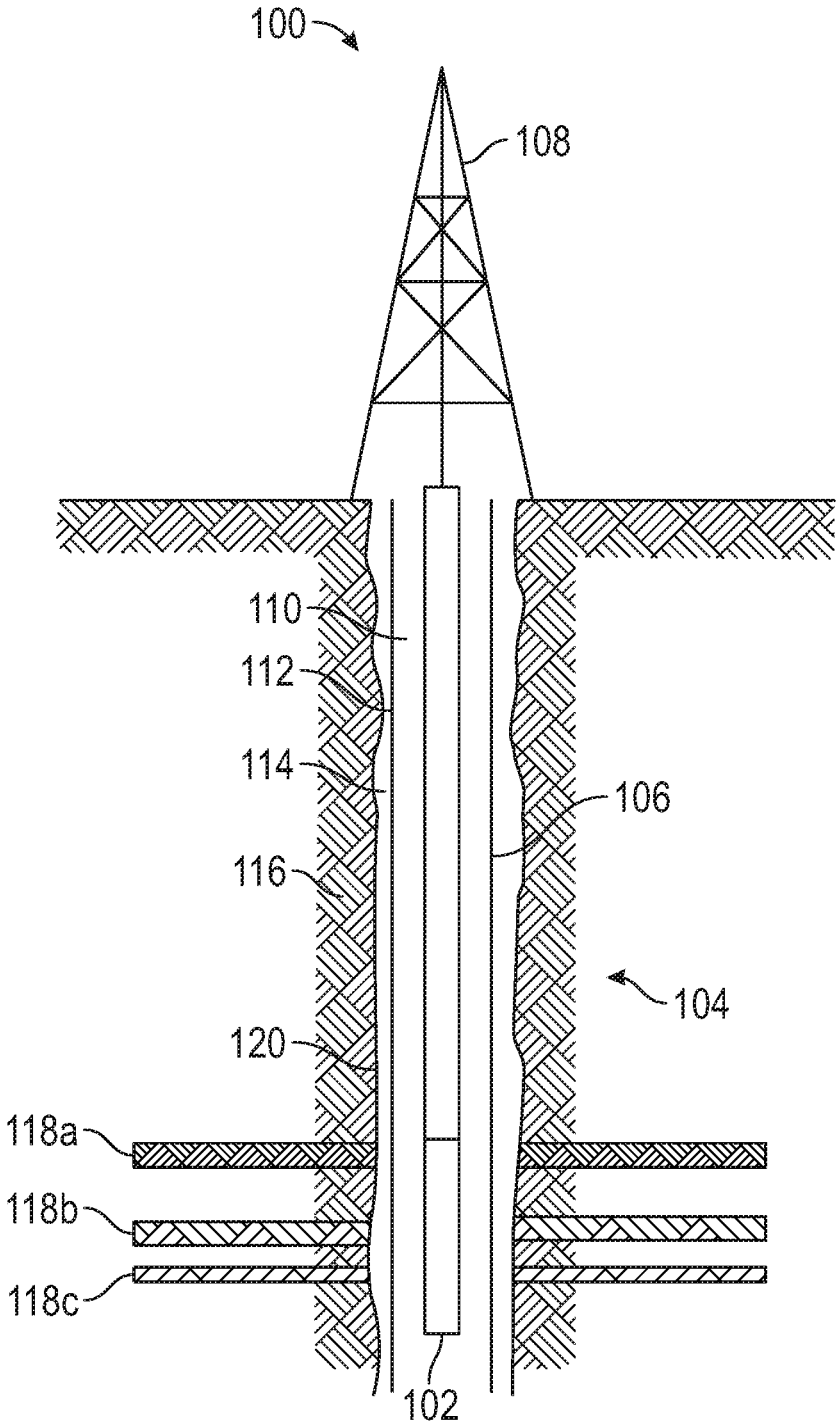
FIG. 1 is a diagram of a system including a perforating gun in a wellbore in a land-based operation.

Disclosed herein are examples of managing energy release in energy perforating devices, such as perforating guns. When perforating guns (e.g., hollow carrier perforating guns) are detonated, the explosives contained inside the guns chemically react, producing heat, pressure, and reaction products. If there is sufficient oxygen available, the process can generally proceed to complete combustion with one of the reaction products being carbon dioxide ($CO_2$). The energy released is called the heat of combustion.

Conversely, if there is insufficient oxygen, the process will proceed as incomplete combustion, with the formation of carbon monoxide (CO) and possibly unburned free carbon as reaction products. The energy released is called the heat of explosion. The numerical value of the heat of explosion is less than the heat of combustion. The difference between these two values represents the additional energy released if surplus oxygen somehow became available in the incomplete combustion process to allow an "afterburn reaction" where carbon monoxide and free carbon react in a secondary process to form carbon dioxide. The afterburn reaction can be combustion after the surplus oxygen becomes available. The afterburn reaction can be the combustion reaction going to completion. The afterburn reaction can be the combustion reaction that occurs after the oxygen inherent in the explosive molecule is consumed in the initial reaction, and the reaction (now labeled an afterburn reaction) relies on oxygen not of the explosive molecule and that can be partial or complete combustion.

In the case of hollow carrier perforating systems, there is typically some level of surplus oxygen available inside the guns that results from the natural presence of air as the guns are simply being loaded in the shop or facility. Unfortunately, the additional energy produced by the afterburn reaction is not useful in the downhole perforating process—it occurs too late to benefit shaped charge performance; detrimentally, the excess energy manifests itself as increased swell, or even rupture, of perforating gun bodies. Moreover, the added impulse from the afterburn can produce unwanted accelerations and tubing movement that may affect other tools present in the perforating string.

This disclosure describes various techniques to prevent the afterburn reaction from occurring, thus reducing or minimizing the energy release inside perforating guns upon detonation. The techniques to eliminate or avoid the afterburn reaction can include removing excess oxygen (e.g., air) from the perforating system. This can be accomplished via different techniques: (1) pulling a vacuum on the gun interior to remove air; (2) displacing air from the gun interior by purging with an inert gas, such as nitrogen, argon, or helium; (3) placing wadding inside the gun interior to reduce or eliminate the free-air; and (4) incorporating an oxygen scavenger or oxygen absorbing component into the system to remove the oxygen from the free-air volume. The techniques [e.g., (1) and (2)] can be extended to oilfield explosive devices beyond hollow carrier guns, such as capsule charges and jet cutters. Embodiments of the present techniques employ a thermochemistry approach to give a technical improvement over a conventional system.

As indicated, oilfield explosive systems (including hollow carrier guns, capsule guns, and jet cutters) utilized can include residual air from the manufacturing and loading processes of the explosive systems. Conventionally, the air is not removed or purged from the explosive systems, and thus this naturally present air remains in these systems.

In contrast, by thermochemically configuring (designing, operating) perforating gun systems to have little or no surplus oxygen, implementations of the perforating gun systems can: (1) have larger charges and greater shot densities, yet still remain within gun swell requirements upon detonation; (2) produce less explosive impulse to the surrounding casing and cement sheath; and (3) facilitate post-shot retrieval of through-tubing gun systems through tight restrictions. In implementations, the techniques can be significantly relevant for explosive systems that are highly oxygen-deficient, such as hexanitrostilbene (HNS). In that case, the techniques may have additional value for high-temperature perforating jobs. In implementations for pipe recovery operations, the techniques may facilitate the thermochemical design or implementation of jet cutters that reduce flair diameter of cut pipe.

The present disclosure pertains to oilfield explosive systems that can utilize common explosive packages for oil and gas operations. Applicable explosives include, for example, pentaerythritol tetranitrate (PETN), royal demolition explosive (RDX), high melting explosive (HMX) (also called octogen), HNS (having the chemical formula $[(O_2N)_3C_6H_2CH]_2$), and 2,6-bis(picrylamino)-3,5-dinitropyridine (PYX). RDX has the chemical formula $(CH_2N_2O_2)_3$ and is also known as cyclonite, hexogen, cyclotrimethylene trinitramine, and 1,3,5-trinitro-1,3,5-triazine. While each of these explosive molecules have different detonation properties and thermal stabilities, they all share in common that they are inherently oxygen deficient. In implementations, the explosive utilized is oxygen deficient for complete combustion. Table 1 gives examples of applicable explosives for the energetic perforating device. The molecular weight (MW) in grams per gram mole (g/gmol) is given. The last column in Table 1 is the oxygen balance in percent (%) by weight. The oxygen balance in a molecule of the explosive is deficient (and indicated by the negative sign) for complete or full combustion for each explosive tabulated.

TABLE 1

| Explosives | | | |
|---|---|---|---|
| Explosive | Chemical Formula | MW (g/gmol) | Oxygen Balance (wt %) |
| PETN | $C_5H_8N_4O_{12}$ | 316.2 | −10.13 |
| RDX | $C_3H_6N_6O_6$ | 222.1 | −21.60 |
| HMX | $C_4H_8N_8O_8$ | 296.2 | −21.62 |
| HNS | $C_{14}H_6N_6O_{12}$ | 450.3 | −67.60 |
| PYX | $C_{17}H_7N_{11}O_{16}$ | 621.3 | −55.37 |

The explosive HMX is utilized as an example for chemical reactions and energy releases in this discussion, with the understanding that the other oxygen-deficient explosives would behave in analogous fashion and could likewise have been selected as an example for dicussion. When the explosive HMX reacts, energy is produced in an oxidation reaction. With little or no excess oxygen (e.g., $O_2$ gas) present, the chemical reaction generally relies solely or mostly upon the oxygen inherently contained within the explosive molecule itself. Due to the negative oxygen balance for the molecule, the reaction proceeds as incomplete combustion, with reaction products of nitrogen, water, and carbon monoxide. For no excess oxygen but only the oxygen in the HMX molecule, the combustion reaction of HMX upon detonation is:

$$C_4H_8O_8 \longrightarrow 4N_2 + 4H_2O + 4CO$$

The heat, or energy, released in this stoichiometrically unbalanced reaction is called the heat of explosion. For HMX, the experimentally determined value is-438.4 kilocalories per gram mole (kcal/gmole) of HMX, with the negative sign indicating release of heat. If additional oxygen somehow becomes available, the carbon monoxide will then react with the oxygen in a secondary "afterburn" reaction to produce carbon dioxide, with the subsequent release of additional energy for that reaction. Ultimately, if there is sufficient oxygen present, the chemical reaction will proceed to complete combustion, with reaction products of nitrogen, water, and carbon dioxide, as shown below for the complete combustion reaction of HMX:

$$C_4H_8N_8O_8 + 2O_2 \longrightarrow 4N_2 + 4H_2O + 4CO_2$$

The heat released in this stoichiometrically balanced reaction is called the heat of combustion, with a value for HMX of −660.7 kcal/gmole. Notably, this amount is 50% greater than the heat of explosion.

In the case of perforating systems (energetic perforating devices), there can be surplus oxygen available to contribute to the afterburn reaction due to ambient air naturally being present inside the gun volume when perforating guns are loaded in the shop or facility. While the amount of excess air, and hence oxygen, may not fully reach the level for a stoichiometrically balanced reaction (complete combustion), any surplus oxygen that is available may drive at least a partial conversion of carbon monoxide to carbon dioxide, with an accompanying additional energy release. Unfortunately, the additional energy produced by the afterburn reaction is typically not useful in the perforating process in that this additional energy release due to the afterburn reaction occurs too late to benefit shaped charge performance. Detrimentally, the excess energy can manifest itself as increased swell, or even rupture, of perforating gun bodies. Moreover, the added impulse from the afterburn reaction may cause unwanted accelerations and tubing movement that affect other tools present in the perforating string.

To inhibit, reduce, or eliminate the onset of afterburn inside the energetic perforating devices (e.g., perforating guns), embodiments of the present techniques include to: (1) use vacuum to remove air from the perforating system, (2) replace air with inert gas (e.g., nitrogen, argon, helium), (3) prevent or reduce entry of air with wadding; and (4) incorporate an oxygen scavenger or oxygen absorbing component into the system to remove the oxygen from the free-air volume, e.g., the oxygen scavenger or oxygen absorbing component can be incorporated in wadding if employed. In each of these techniques, the thermochemistry of the system is configured to reduce or eliminate the presence of additional oxygen, which, if present, would generally drive secondary afterburn reactions and thereby generate unwanted additional energy release. Thus, aspects of these techniques involve controlling the detonation reaction inside a perforating system such that the only oxygen available for reaction is solely or mostly that which inherent to the explosive molecule itself. This solution is for controlling the chemical reaction of the explosives that are detonated as part of the perforating process. This control of reaction can be to limit or predetermine the pressure generated by the explosion.

While the discussion herein may focus at times on perforating guns as an energetic perforating device (EPD), the EPD can include, for example, capsule guns, jet cutters, and the like. A capsule gun, also known as a capsule-charge gun or exposed gun system, is a perforating tool used in wells (wellbores) (e.g., oil and gas wells or wellbores), specifically, for example, for through-tubing wireline operations, where shaped charges are housed in individual, pressure-tight capsules mounted on a carrier strip. A capsule gun is typically utilized primarily in wireline operations. Again, this gun system has shaped charges that are housed in individual pressure-tight capsules mounted on a metal strip, which is lowered into the wellbore.

A jet cutter (explosive jet cutter) utilizes shaped explosive charges to cut through tubing or casing (casing walls), e.g., in well workover and intervention operations. Applications can include tasks such as well as abandonment, salvage operations, cutting through obstructions in pipelines, and so forth. Explosive jet cutters are effective in situations where conventional cutting methods are not feasible, such as in wells with low fluid levels or heavy mud. An explosive jet cutter is a downhole tool used in well workover and intervention, utilizing a shaped explosive charge to cut through tubing, casing, or drill pipe, often employed during pipe recovery or workover activities. These cutters can be designed to provide a relatively quick and effective solution for severing tubing, casing, and drill pipe during recovery operations or workover activities, especially when dealing with stuck pipe or other complications. Explosive jet cutters work by detonating a shaped explosive charge, which generates a radial explosive jet that cuts through the target material. As indicated, explosive jet cutters are used in various oil and gas well intervention scenarios, including pipe recovery (e.g., severing stuck or damaged pipe), workover activities (e.g., cutting tubing or casing to facilitate repairs or modifications), and plug and abandonment (e.g., cutting casing for plug and abandonment operations). In implementations, jet cutters are explosive shaped charges designed to give a 360° cut (by use of a jet formed from the shaped charge) for coiled tubing, tubing, or casing.

The techniques include methods of deploying (applying, operating) an EPD having an explosive to and in a wellbore. The explosive can be, for example, PETN, RDX, HMX, HNS, PYX, and so forth. The wellbore is formed in a subterranean formation. The EPD can include, for example, a perforating gun (e.g., hollow carrier perforating gun), a capsule gun, a jet cutter, etc.

Prior to deploying (e.g., including lowering) the EPD into the wellbore, the methods can include removing (displacing) air from the EPD, such as from the interior (interior volume) of the EPD. For instance, the interior volume of the EPD can be purged with a gas to displace (replace) the air with the gas. The gas can be an inert gas, such as nitrogen, argon, helium, and the like. In implementations, the gas can be a gas having less than 5 weight percent (wt %) of oxygen ($O_2$), less than 3 wt % of $O_2$, or less than 1 wt % of $O_2$. In implementations, to purge the EPD, a conduit (e.g., hose, pipe, etc.) can be coupled to the EPD to supply the gas into the interior of the EPD, such as via a pump or a supply pressure of gas cylinder or header, and the like. In implementations, the air can be removed from the EPD, for example, by pulling a vacuum on the EPD to draw (evacuate) the air out of the interior volume of the EPD. The vacuum can be pulled (applied) on the EPD, for example, by a vacuum pump, vacuum jet (e.g., steam jet), etc.

The methods can include inhibiting or reducing the entry of air into the EPD by placing wadding in the interior volume of the EPD. Wadding is material to be situated in a space. The wadding can include, for example, metal (e.g., steel, aluminum, etc.), polymer, plastic, foam (e.g., spray foam, foam pellets, etc.), plastic bags filled with inert gas, plastic capsules filled with inert gas, fluid-filled plastic bags, and so on.

Another method can include oxygen scavenger or oxygen absorbing compounds as wadding materials inside the EPD. The reaction of such compounds reduces the amount of oxygen in the open volume of the system. These compounds can include, for example, sodium sulfite, sodium bisulfite, ascorbic acid, sodium sulfite, silica, activated carbon, clays, and so on. These wading materials can be packed in porous packets, envelopes, bags or other containment structures, e.g., such that the volume of the material is contained in an efficient manner to facilitate placement and the prescribed amount of oxygen reduction. It should be understood that the same materials could be placed into the EPD without the use of containment structures.

The methods include placing the EPD into the wellbore. For instance, the EPD can be lowered (e.g., from the Earth surface) into the wellbore. The methods include forming a perforation (e.g., multiple perforations) in the wellbore with the EPD by detonating the explosive of the EPD. The perforation can be a hole or rupture, and the like. The wellbore can include a casing, and wherein forming the perforation includes forming the perforation in the casing, such as with the EPD as a perforating gun (e.g., hollow carrier perforating gun).

The combustion of the explosive is beneficially incomplete due to the removing of the air from the interior volume of the EPD (and/or due to the inhibiting of entry of air into the EPD). The removal of the air (or restraining of air into the EPD) limits the combustion of the explosive. The combustion of the explosive being incomplete due to the removing of the air from the EPD (and/or restraining the entry of air into the EPD) is caused by deficiency of oxygen in the EPD. The amount of oxygen in the EPD is less than the stoichiometric amount for complete combustion of the explosive. The oxygen in the EPD includes any elemental oxygen of the explosive, as well as any oxygen gas ($O_2$) in the interior volume of the EPD. With the incomplete combustion, reaction product of the combustion can include carbon monoxide (CO), as well as solid elemental carbon instances. In implementations, the thermochemistry of the detonation reaction is intentionally designed to yield no $CO_2$ as a reaction product (or at the very least, only an insignificant, or trace, amount).

It should be emphasized that the perforating tool assembly and associated perforating guns of FIGS. 1-9, as depicted and discussed, are given only as examples and not meant to limit the present techniques. Other types and configurations of perforating guns are applicable.

FIG. 1 is a system 100 including energetic perforating devices as a perforating tool assembly 102 in a wellbore 110 during a land-based operation. The system 100 comprises a servicing rig 108 disposed on a terrestrial surface over a wellbore 110 extending into subterranean formation 116. Wellbore 110 may be vertical, deviated, horizontal, and/or curved at one or more regions of subterranean formation 116. Wellbore 110 may be cased, open hole, contain tubing, and may generally comprise a hole in the ground, e.g., "borehole", extending any appropriate distance into subterranean formation 116. In one or more examples, one or more regions of the wellbore 110 may be secured at least in part by cement.

Servicing rig 108 may be a drilling rig, completion rig, workover rig, or other mast structure supporting work string 104. In some examples, servicing rig 108 comprises a derrick and rig floor through which work string 104 extends downwards into wellbore 110. As will be shown in FIG. 2, a wellbore may be alternatively positioned in a sea-based environment, such as on a semi-submersible platform or rig, or otherwise disposed above a sea floor at an off-shore location.

Figure 3:
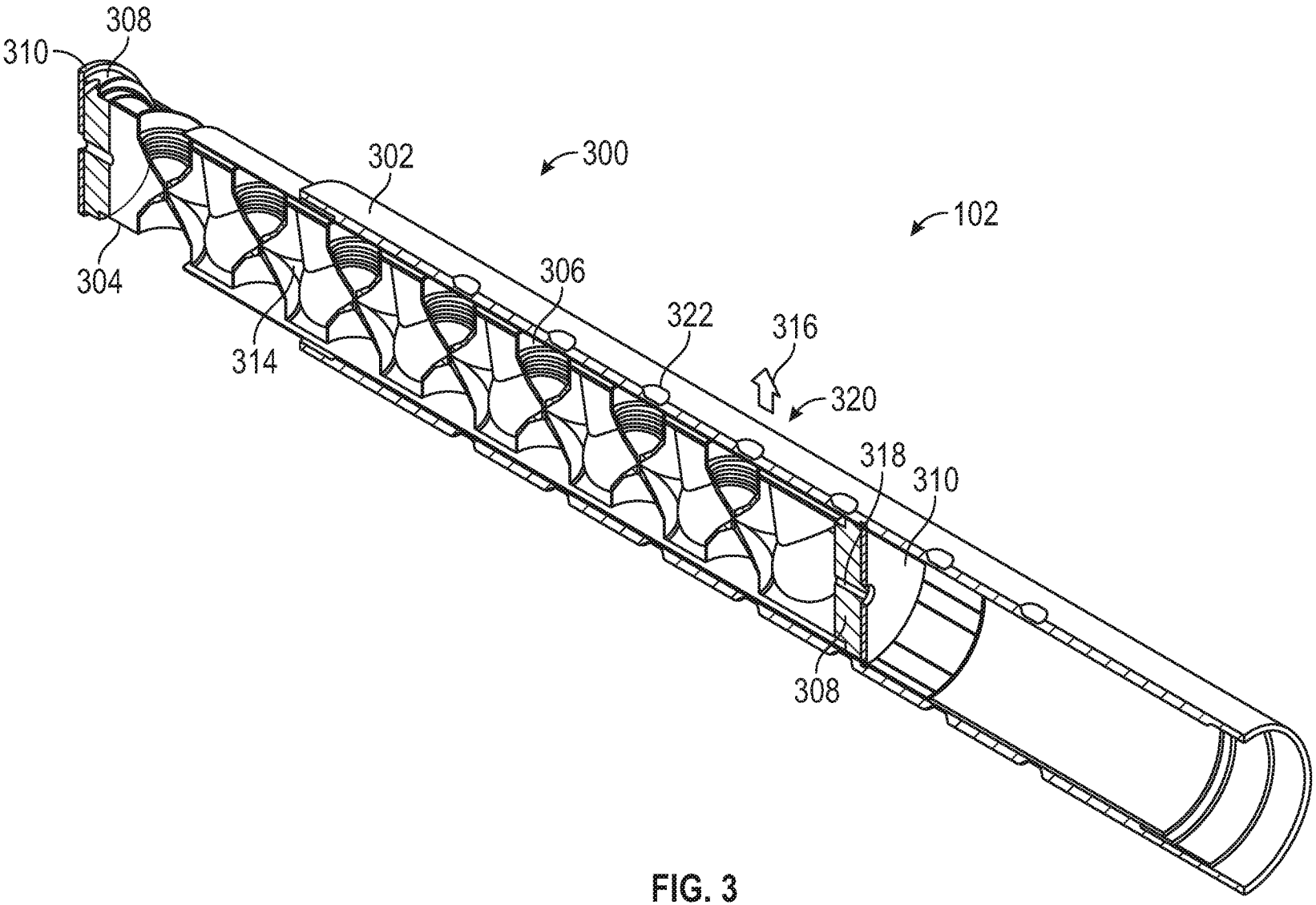
FIG. 3 is a perspective cross-sectional view of a perforating gun of a perforating gun string.

As illustrated, work string 104 may comprise a conveyance 106 and an energetic perforating device as a perforating tool assembly 102, e.g., "perforating gun string," "gun string," "perf gun assembly," or "gun assembly," comprising one or more perforating guns (e.g., perforating gun 300 of FIG. 3). In addition, work string 104 may comprise other downhole tools, such as one or more packers, one or more completion components (e.g., screens and/or production valves), one or more sensing components and/or measuring equipment (e.g., downhole sensors), and other equipment. In operation, work string 104 is lowered into wellbore 110 and one or more explosive charges disposed within the one or more perforating guns are detonated to perforate casing 112 to facilitate fluid communication between one or more production zones ("pay zones") 118*a*, 118*b*, 118*c*, etc., and wellbore 110.

Perforating tool assembly 102 may comprise a single or a plurality of perforating guns, which may be coupled together, for example, on a single gun string. While the present figures generally show a single, or a few perforating guns, it should be understood that perforating tool assembly 102 may comprise a number of perforating guns. In one or more examples, the perforating tool assembly 102 may further comprise a firing head for initiating a detonation train to fire each of the perforating guns. In addition, the perforating tool assembly 102 may further comprise tandems, spacers, or other coupling structures for coupling together the perforating guns.

Figure 2:
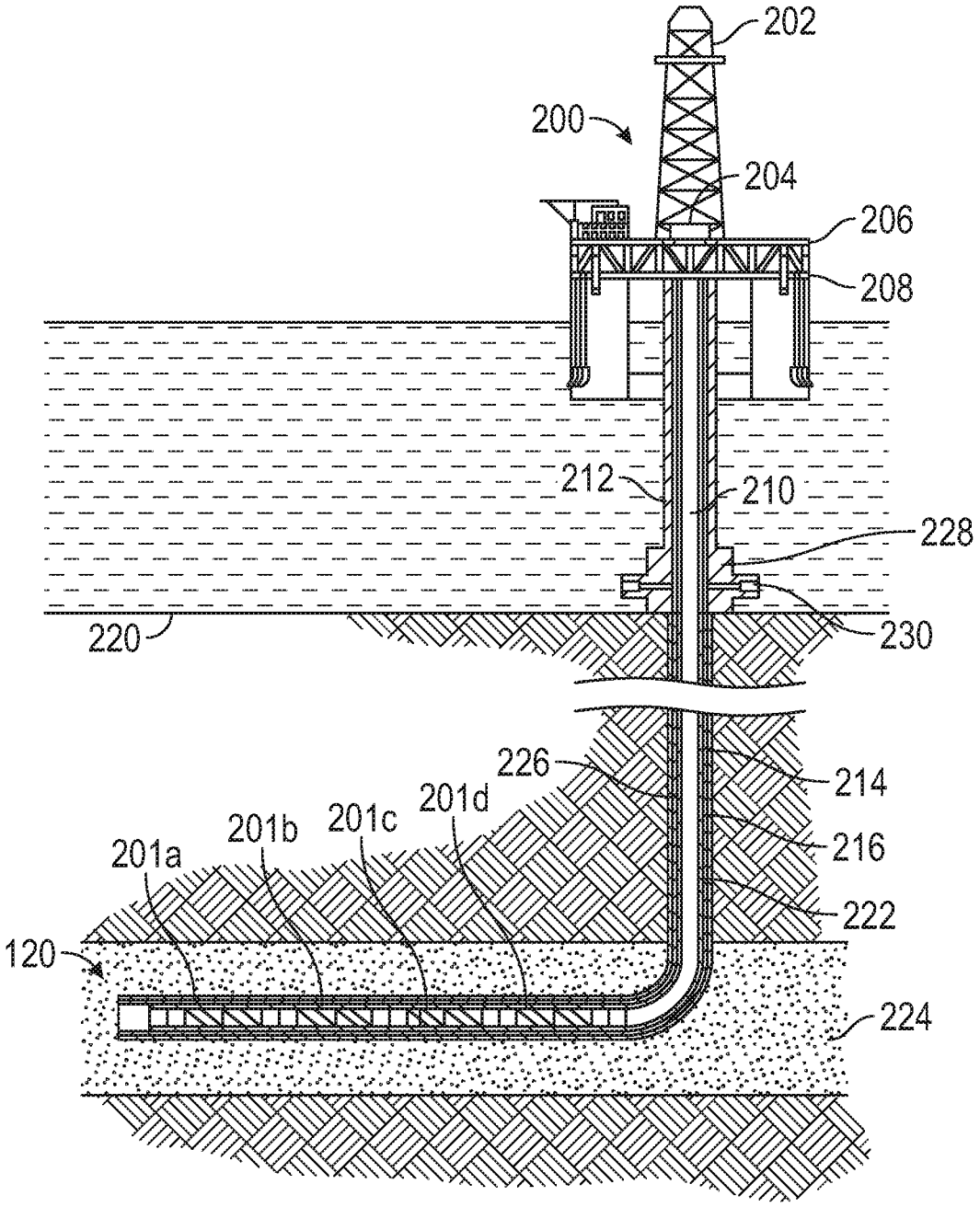
FIG. 2 is a diagram of a system including a perforating gun in a wellbore in a sea-based operation.

FIG. 2 is a system 200 showing one or more perforating guns 201*a*, 201*b*, 201*c*, 201*d*, etc., in a wellbore 214 during a sea-based operation, in accordance with some examples of the present disclosure. As mentioned, the principles shown and described with respect to perforating during land-based operations are equally applicable to sea-based operations, and vice versa.

As illustrated, a wellbore 214 may extend into a subterranean formation 224 beneath a sea floor 220. A semi-submersible platform 206 is centered over a hydrocarbon-bearing formation 224 located beneath a sea floor 220. A subsea conduit 212 extends from deck 208 of platform 206 to wellhead installation 228 which may include one or more subsea blow-out preventers 230. Platform 206 has a hoisting apparatus 204 and a derrick 202 for raising and lowering tubular strings such as work string 210.

A wellbore 214 extends through various earth strata including subterranean formation 224. Casing 226 is cemented within wellbore 214 by cement 216, as with FIG. 1. Work string 210 may be substantially identical to work string 104 (e.g., referring to FIG. 1), except that it is adapted for a subsea environment. In operation, work string 210 is similarly lowered through casing 226 until one or more perforating guns of work string 210 reach a desired depth. Thereafter, the explosive charges are detonated to perforate casing 226. In either of FIG. 1 or 2, detonation may occur in either a down-going (downhole) or an up-going (uphole) fashion. As shown, work string 210 comprises one or more perforating guns 201*a*, 201*b*, 201*c*, 201*d*, 201*n* which may be joined together during, for example, tubular make-up of the gun string.

FIG. 3 is an exploded cross-sectional perspective view of a perforating tool assembly 102 comprising a perforating gun 300 (an energetic perforating device) to show the internal part of the perforating tool assembly 102, in accordance with one or more embodiments of the present disclosure. The perforating gun 300 can be characterized or labeled as a hollow carrier perforating gun. As illustrated, perforating tool assembly 102 comprises at least one perforating gun 300 which is shown as comprising various tubular and non-tubular members which are disposed within a gun body 302. Gun body 302 may also be referred to as a "gun carrier" in this context, whereby it possesses the ability to carry or house the other members of the perforating gun 300. These various tubular and non-tubular members comprise, for example, a charge tube 304 extending along the gun body 302, a plurality of perforating charge cases 306 and their associated charges (e.g., shaped charges), end alignment(s) 308, and end pieces 310. The charge tube 304 is held in place within the gun body 302 by one or more (e.g., two) end alignments 308, which are shown as being disposed at opposite ends of the charge tube 304. The charge tube assembly, which comprises a charge tube 304 and perforating charge(s) (e.g., perforating charges 602 of FIG. 6), as well as the pair of end alignments 308, may be book-ended by one or more end pieces 310 in some examples. The end pieces 310 may serve to cap either end of each perforating gun 300 and may serve to facilitate filling the inner cavity 314 of the charge tube 304 with wadding to inhibit the entry of air into the perforating gun 300.

The charge cases 306 are configured to house perforating charges (not shown) and one or more projectiles (e.g., conical metal liners). The charge cases 306 also have a substantially conical profile, as illustrated, for directing the explosive energy of the perforating charges in a firing direction 316 schematically illustrated by the arrow in FIG. 3. Subsequent to detonation of a detonating cord (e.g., detonating cord 502 of FIG. 5), the perforating charges may be detonated in a serial fashion along the length of the charge tube 304, forming hot, expanding gas which causes the "metal liners (e.g., conical metal liner 604 on FIG. 6) to invert before blasting through the gun body 302 and jetting, e.g., hydrodynamically pushing, through the casing 112, 226 and into the formation 116, 224 (e.g., referring to FIGS. 1 and 2). This opens the wellbore 110, 214 to the formation 116, 224 (e.g., referring to FIGS. 1 and 2), allowing free fluid communication between the wellbore 110, 214 and the reservoir. This can be characterized as forming perforations.

The end alignments 308 and end pieces 310 have a centerline hole and feedthrough 318 that allow a detonating cord (e.g., detonating cord 502 of FIG. 5) to feed through. In operation, the detonating cord may be linked to each charge case such that the detonation proceeds in a downhole fashion from a firing head. Alternative configurations are possible, for example, wherein detonation proceeds in an uphole fashion. The end alignments 308 and/or end pieces 310 may also function to align the charge tube 304 at a specific orientation within the gun body 302 to ensure, for example, that the firing direction 316 of each perforating gun 300 corresponds to one or more reduced wall thickness sections 320 of the gun body 302, e.g., at the scallops 322 formed within the gun body 302. Scalloped guns and slick-wall guns (guns that are not scalloped) are examples. Scallops reduce wall thickness to reduce the possibility of burrs which would extend beyond the outer diameter of the perforating gun 300. This helps to avoid damage to the interior of the well and its associated equipment during retrieval of the gun after detonation. The teachings and principles provided herein are applicable to both scalloped and non-scalloped types of guns. One primary purpose of the end alignments 308 is, in some examples, to ensure that the charge tube 304 does not physically contact the gun body 302. End alignments 308 may also house other components of the perforating gun 300, such as the detonator (not shown), for example.

Figure 4:
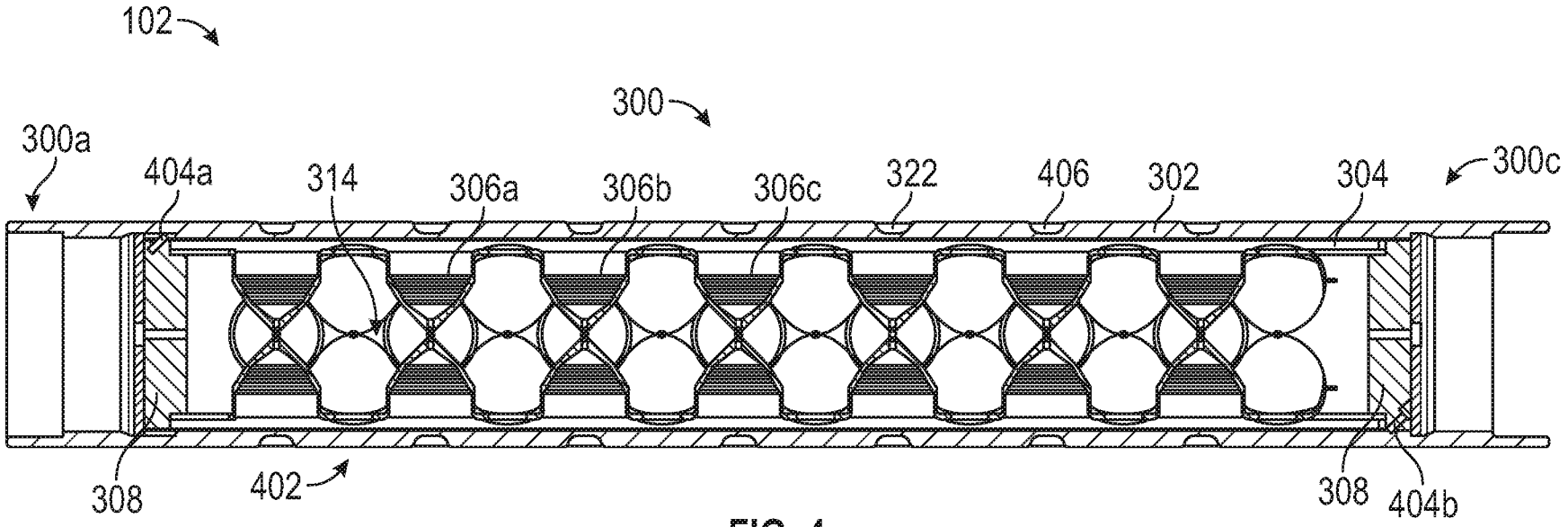
FIG. 4 is a cross-sectional side view of the perforating gun of FIG. 3.

FIG. 4 is a cross-sectional side view of the perforating gun 300 of FIG. 3, except that it is shown as being disposed between second (downhole) and third (uphole) perforating guns 300*a*, 300*c*. As illustrated, the perforating gun 300 comprises a plurality of charge cases 306*a*, 306*b*, 306*c*, etc. which may be form quadrantal sets 402 arranged in a linear fashion along the central axis of the perforating tool assembly 102, as illustrated. In the illustrated example, the charge cases 306 which would be oriented out of the plane (i.e., coming out of the page) are omitted for reference. Alternative configurations are possible, for example, non-quadrant orientations having more or less than four charge cases 306*a*, 306*b*, 306*c* per set 402 (e.g., three, five, six, etc.), depending on the thickness and/or inner diameter of the casing 112, 226 (e.g., referring to FIGS. 1, 2), desired perforation density, and/or desired penetration depth of the projectiles into the formation. Each set 402 of charge cases may be linearly arranged, as shown, or may be offset from each other to allow more narrow packing of the charge cases 306*a*, 306*b*, 306*c* and thus a greater number of charge cases 306*a*, 306*b*, 306*c* per length of charge tube 304. It should be understood that other arrangements of charge 306 may also be used on the arrangement shown on FIG. 4. This arrangement depicted is merely one example.

As illustrated, one or more set screws 404*a*, 404*b* may be used to secure the end alignments 308 and/or the charge tube 304 within the gun body 302. In the illustrated embodiment, at least two set screws 404*a*, 404*b* are used for each perforating gun 300, with a first set screw 404*a* at a downhole end of the perforating gun 300 and a second set screw 404*b* at an uphole end of the perforating gun 300 opposite and diagonal to the first set screw 404*a*. The set screws 404*a*, 404*b* may serve to limit the mobility of the charge tube 304 relative to the end alignment 308 and/or gun body 302. Alternative set screw configurations are possible, for example, with one or more radially oriented (i.e., perpendicular to the central axis of the perforating gun 300) set screws in addition to, or instead of, set screws 404*a*, 404*b*, for example, opposite those shown in FIG. 4 on the end alignment 308.

The scallops 322 primarily serve to provide a recessed outer surface to limit the extension of burrs beyond the outside diameter of the gun carrier. As such, the scallops result in weakened areas of the gun body 302. As mentioned, this allows the high pressure expanding gases of the detonated charges to hydraulically push one or more metal liners (e.g., conical metal liner 604 referring to FIG. 6) radially outwards from the charge cases 306*a*, 306*b*, 306*c* and out through the gun body 302. Weakening the gun body 302 at these areas ensures that the path of least resistance for the explosive energy is in the firing direction 316. Subsequent to detonating of the perforation charges, the metal liner inverts during the process, thereby forming a projectile that jets out through the casing 112, 226 (e.g., referring to FIGS. 1, 2) and into the formation. The specific orientation of the scallops 322 along the gun body 302 may vary, for example, wherein a single scallop 322 is associated with each charge. Placement of the end alignment(s) 308 and/or set screws 404*a*, 404*b* at the correct orientation may, in some examples, ensure that the firing directions associated with each charge case line up with the corresponding weakened portion(s) of the gun body 302. In some examples, the end alignment 308 may be configured such that it allows a limited number of (e.g., one) acceptable orientations of the charge tube 304 relative to the gun body 302.

Figure 5:
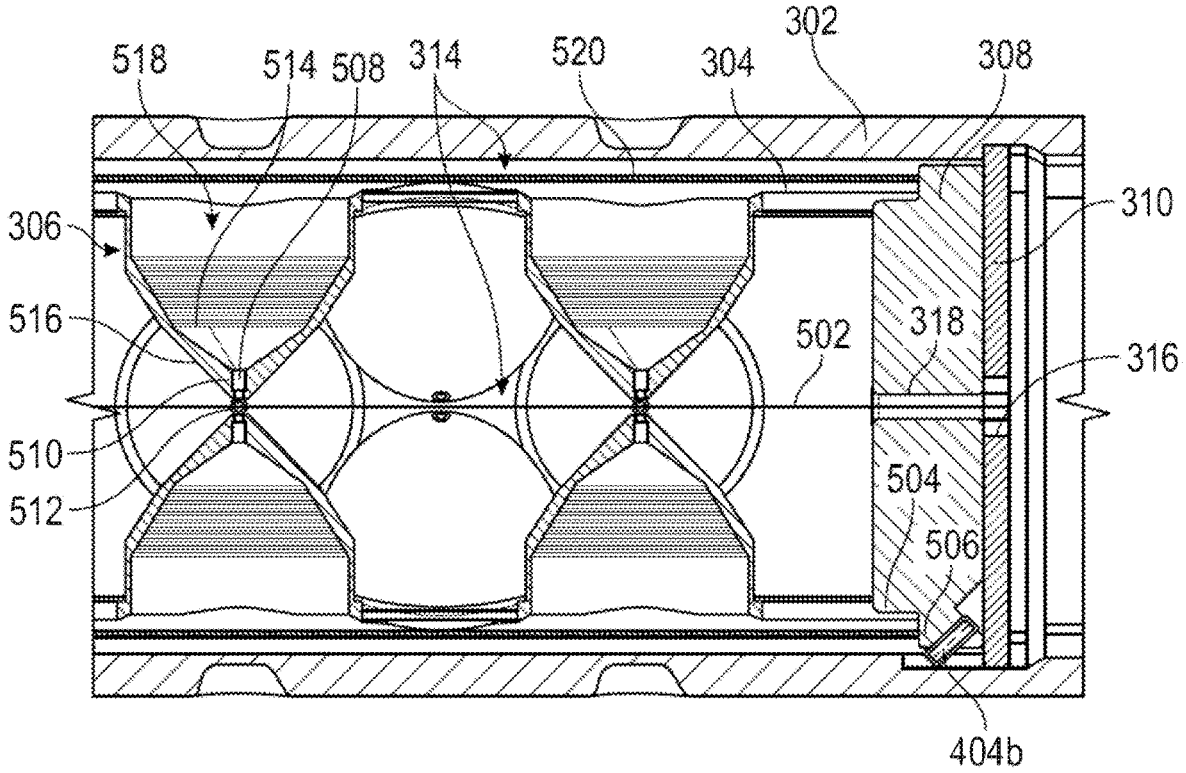
FIG. 5 is an enlarged cross-sectional side view of the perforating gun of FIG. 4 to show the detonating cord.

FIG. 5 is a close-up view of FIG. 4, which shows the detonating cord 502 routed along the centerline of the perforating gun 300, in accordance with one or more embodiments of the present disclosure. Visible in this figure is the detonating cord 502 extending from the centerline hole and feedthrough 318 of the end piece 310 and end alignment 308, along the length of the charge tube 304, and in the downhole direction. Also visible is the second set screw 404*b*, which locks the end alignment 308 to the gun body 302, e.g., without physically contacting the charge tube 304. The end alignment 308, part of which is shown as being seated within the charge tube 304, may limit movement of the charge tube 304 in the axial direction as well as in the differential (i.e., tangential to the circumference) direction of the charge tube 304.

As illustrated, the end alignment 308 comprises a generally tubular body having at least a narrow portion 504 and a wider portion 506. The narrow portion 504 may conform to an inner (or outer) diameter of another tubular member of the perforating gun 300, e.g., the inner diameter of the charge tube 304 in the illustrated example. The wider portion 506 may also conform to an inner diameter of a tubular member of the perforating gun 300, e.g., the inner diameter of the gun body 302 in the illustrated example. This view also shows the detonating cord feedthrough 318 of the end alignment 308 as well as the detonating cord feedthrough 318 of the end piece 310. In the illustrated example, both the feedthrough 318 and centerline hole are oriented along the central axis of the perforating tool assembly 102 (e.g., referring to FIG. 1), and by extension, the central axis of the gun body 302, charge tube 304, end alignment 308, and end piece 310. This specific configuration may, in some examples, ensure that the detonating cord 502 is sheltered from external influences (e.g., the wellbore 110, 214, wellbore fluid, etc.). Such placement may, in some examples, also allow for the detonation to propagate more rapidly along the length of the charge tube 304 than what could be achieved in other configurations, which may be a desired characteristic for longer types of guns (e.g., 22', or greater than 15' (4.6 meters), as measured between end alignment 308 and end alignment 308). Rapid detonation of the detonating cord (relative to the detonating of the perforating charges) may ensure or promote that the traveling detonation along the detonating cord is unhindered by pressure waves, influx of wellbore fluids, or other effects associated with detonating of the perforating charges. For example, use in this manner may prevent or reduce the likelihood of incomplete detonation of the detonation train.

Other configurations for the detonating cord are also possible. For example, rather than the detonating cord feedthrough 318 being positioned along the central axis of the perforating gun 300, the detonating cord 502 may instead be wrapped helically around the charge tube 304, fed through a non-centerline hole of the end alignment 308 and end piece 310, or configured in any suitable fashion to detonate the perforating charges within the charge cases 306. In yet alternative configurations, rather than relaying the detonation signal along the detonating train directly with the detonating cord, one or more signal conductors (e.g., flexible wire, ribbon, electric trace, etc.) may be used. In such examples, it may be necessary to include individual detonators within each perforating gun 300, where each detonator ignites a separate detonating cord corresponding to each perforating gun.

An opening 508 may be disposed at the vertex 510 of each charge case 306, as illustrated. This allows the detonation of the detonating cord 502 to trigger explosions of the perforating charges nested within the charge cases 306. Near or at the center line of the perforating gun 300 near or at the openings 508 of each of the charge cases 306, an explosive initiator 512 may be disposed to ensure good detonation of each perforating charge and to reduce the risk of incomplete detonation. An explosive initiator 512 may be as simple as an added amount of explosive material. Alternatively, the explosive initiator 512 may comprise, for example, a primary explosive and a secondary explosive. Where used, the primary explosive may be extremely sensitive to stimuli, such as to an electrical signal. The secondary explosive may be a larger quantity of a less sensitive explosive material triggered by the primary explosive. Any suitable explosive material can be used, as a variety of explosive materials for use in various detonating systems is generally available. In one or more examples, the explosive initiator 512 may comprise a shell (not shown), wherein an explosive material is disposed within the shell. The explosive materials can have a negative oxygen balance. The explosive material(s) can be, for example, PETN, RDX, HMX, HNS, PYX, and so on.

As illustrated, each charge case 306 has an interior conical surface 514 and an outer surface 516. As previously mentioned, the charge case 306 houses the perforating charge and the conical metal liner. Outside the charge case 306 and between charge cases 306 is the inner cavity 314 of the charge tube 304. In implementations, the inner cavity 314 and/or other inner portions of perforating gun 300 can include wadding, e.g., see FIG. 7. Inner cavity 314 may be generally characterized as the space(s) within the charge tube 304 between the charge cases 306. Specifically, the "inner cavity" is defined as any one or more region(s) within the charge tube that is not directly contiguous with a perforating charge. Empty spaces may exist within other regions of the charge tube 304 or perforating gun 300.

Figure 6:
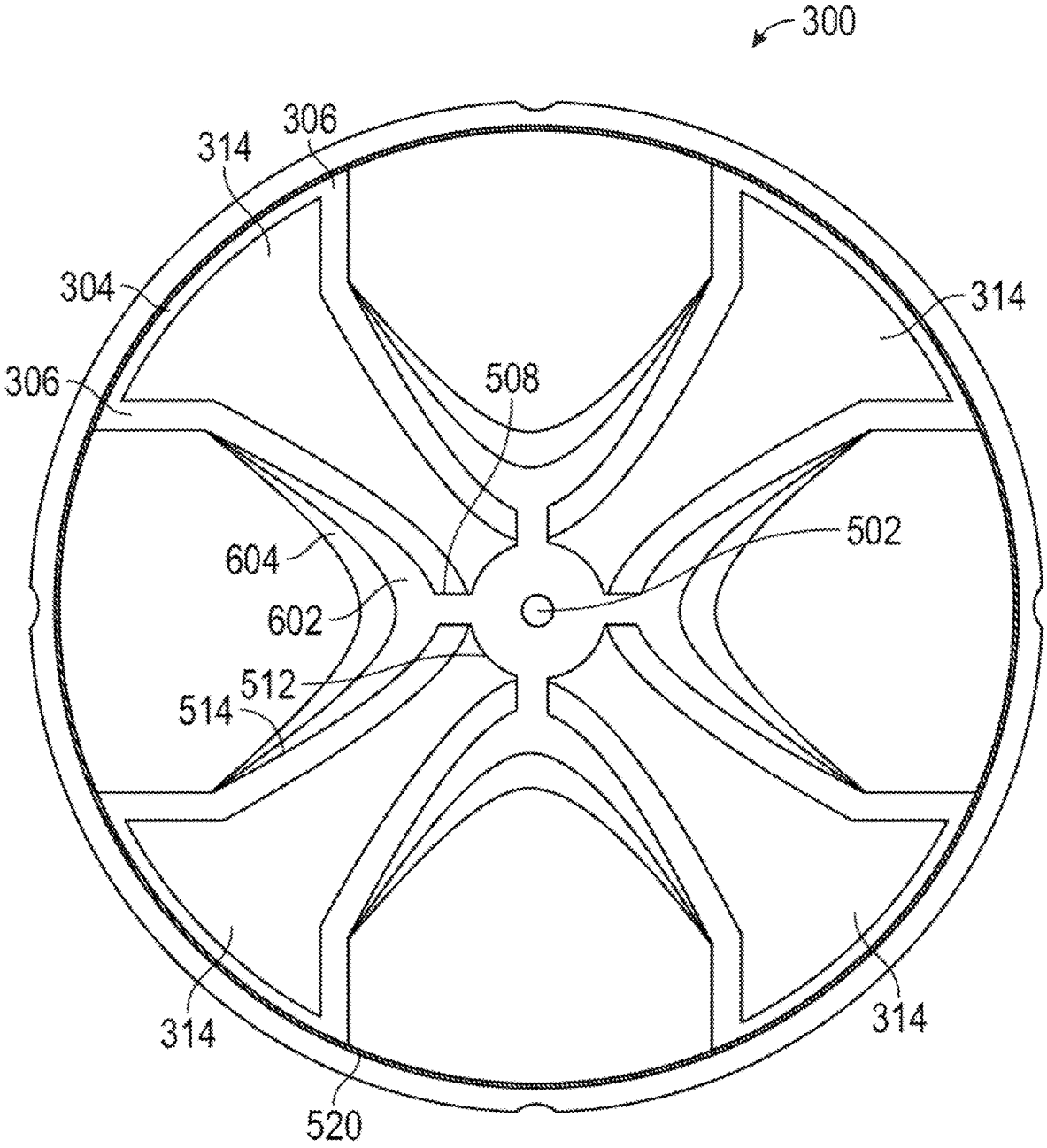
FIG. 6 is a cross-sectional end view of the perforating gun of FIGS. 3-5.

FIG. 6 is a downhole cross-sectional view of the perforating gun 300. This view shows a quadrantal set 402 (e.g., referring to FIG. 4) of charge cases 306 which are installed within the charge tube 304 and radially aligned relative to the central axis of the perforating gun 300, in accordance with one or more embodiments of the present disclosure. At the center point of the charge tube 304 is the detonating cord 502, which may be proximate to and/or housed within an explosive initiator 512. The openings 508 of the charge cases 306 are also shown, which allow for communication between the detonating cord 502 and a perforating charge 602. As illustrated, the perforating charge 602 is disposed between the interior conical surface 514 of the charge case 306 and the conical metal liner 604. Also visible in this figure is the gun body 302 disposed about the charge tube 304, as well as the one or more scallops 322 formed within the gun body 302. The inner cavity 314 of the charge tube 304 is also shown. As mentioned, this space may be supplied or loaded with wadding.

Figure 7:
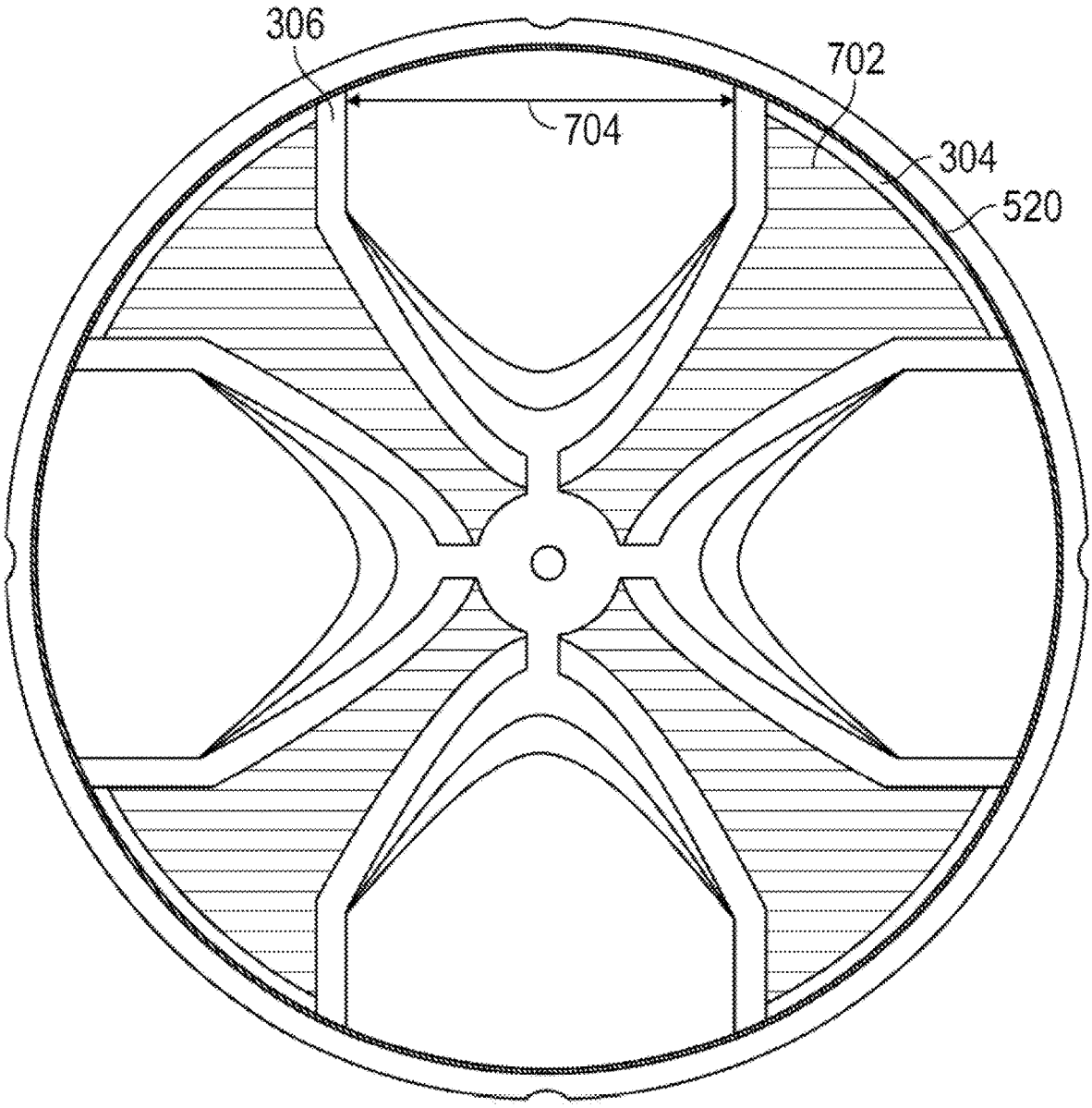
FIG. 7 is the cross-sectional end view of the perforating gun of FIG. 6 with a cavity having wadding disposed therein.

FIG. 7 is identical to FIG. 6, except that wadding 702 is disposed within at least a portion of the inner cavity 314 (e.g., referring to FIGS. 3-6) of the charge tube 304, as indicated by the horizontal lines. The wadding 702 may include, for example, polymer, foam, metal, resin, plastic bags filled with inert gas, plastic capsules filled with inert gas, fluid-filled plastic bags, oxygen-scavenging containment structures, and so forth.

Figure 8:
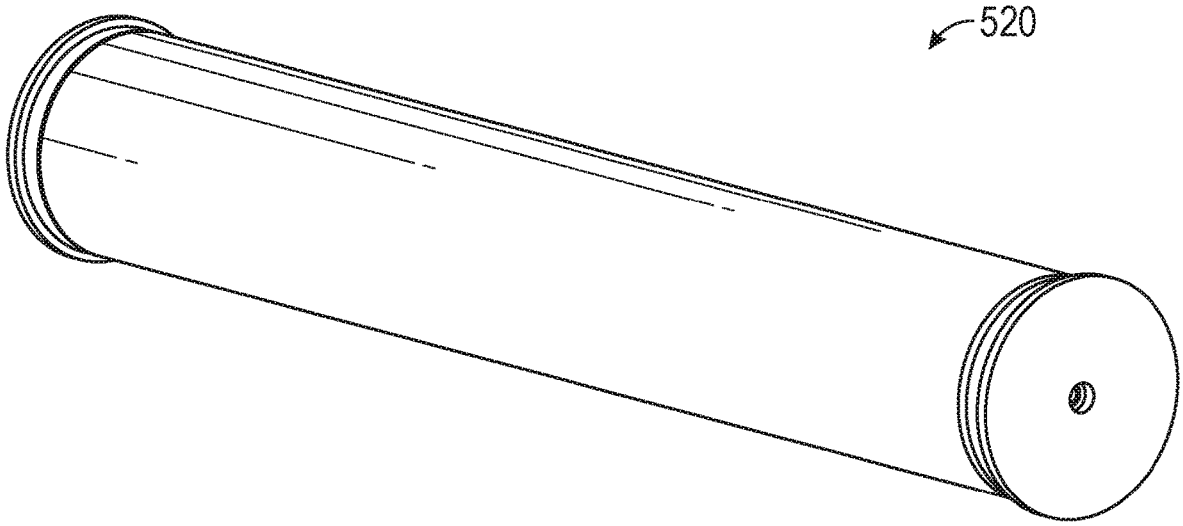
FIG. 8 is a perspective view of the perforating gun of FIG. 3 with the gun body omitted for reference to show a sleeve.

FIG. 8 is a perspective view of a perforating gun 300 with the gun body 302 (e.g., referring to FIG. 3) omitted for reference to show the sleeve 520 disposed about the charge tube 304, in accordance with one or more embodiments of the present disclosure. As mentioned, the sleeve 520 may be circumferentially disposed about the charge tube 304. In this view, the sleeve 520 is shown as being disposed about a substantial portion of (e.g., entirety of) the outer surface area of the charge tube 304. Advantages of this may include, in some examples, ergonomic assembly, as it may be easier to wrap the charge tube than to section off specific portions only. Prior to or during tubular make-up of a perforating tool assembly 102 (e.g., referring to FIG. 1), the sleeve 520 is wrapped around the charge tube 304. The charge tube 304 may be fully loaded with perforating charge(s) 602 and a conical metal liner 604 (e.g., referring to FIGS. 6, 7) prior to applying the sleeve 520 about the charge tube 304, or alternatively, may be loaded thereafter. The wadding 702 (e.g., referring to FIG. 7) if employed may be introduced into the inner cavity 314 (e.g., referring to FIGS. 3-6), for example, before finally being installed within the gun body 302.

An embodiment is a method of deploying an EPD (e.g., a perforating gun, a capsule gun, or a jet cutter) having an explosive into a wellbore. The method includes removing air from an interior volume of the EPD, and placing the EPD into the wellbore in a subterranean formation. The method includes forming a perforation (e.g., multiple perforations) in the wellbore with the EPD by detonating the explosive. The removing of the air limits reaction of the explosive, thereby limiting production of heat due to the reaction. In implementations, the removing of the air from the EPD involves displacing the air by purging the EPD with an inert gas, thereby replacing the air with the inert gas. In implementations, the removing of the air from the EPD involves pulling a vacuum on the interior volume of the EPD to remove the air. In implementations, the removing of the air limits the reaction to heat of explosion, thereby limiting pressure in the EPD caused by the reaction. In implementations, the removing of the air limits the reaction to below heat of combustion. In examples, the heat of combustion is at least 50% greater than heat of explosion of the reaction. In implementations, the removing of the air limits reduces oxygen in the EPD device, thereby reducing pressure in the EPD caused by the reaction. In implementations, the removing of the air limits the reaction due to the removing of the air causing a deficiency of oxygen ($O_2$) in the EPD for the reaction, wherein a reaction product of the reaction is carbon monoxide (CO). In implementations, the wellbore has a casing, and wherein forming the perforation includes forming the perforation in the casing.

Another embodiment is a method of deploying an EPD (e.g., a perforating gun, a capsule gun, or a jet cutter) having an explosive into a wellbore in a subterranean formation. The method includes removing air from an interior volume of the EPD, placing the EPD into the wellbore, and forming a perforation in the wellbore with the EPD by detonating the explosive. The removing of the air limits reaction of the explosive, thereby limiting production of carbon dioxide in the EPD caused by the reaction. In examples, the explosive includes PETN, RDX, HMX, HNS, or PYX, or any combinations thereof. In implementations, the removing of the air from the EPD includes utilizing a vacuum to remove the air. In implementations, the removing of the air from the EPD includes replacing the air with an inert gas (e.g., nitrogen gas, argon gas, or helium gas, or any combinations thereof. In implementations, a product of the reaction is solid elemental carbon.

Yet another embodiment is a method of deploying an EPD having an explosive into a wellbore. The method includes removing air from an interior volume of the EPD or inhibiting external air entering the interior volume, or a combination thereof. The method includes placing the EPD into the wellbore, and forming a perforation in the wellbore with the EPD by detonating the explosive, wherein the removing the air or the inhibiting the external air, or the combination thereof, limits reaction of the explosive. In implementations, the removing the air or the inhibiting the external air, or the combination thereof, thereby limiting the reaction reduces an amount of carbon dioxide produced by the reaction and reduces heat produced by the reaction. In implementations, the method includes the removing the air. In implementations, the method includes the inhibiting external air entering the interior volume. In implementations, the method includes both (the combination of) the removing of the air and the inhibiting of the external air. In implementations, the removing of the air includes displacing the air by purging the EPD with a gas having less than 5 wt % of oxygen ($O_2$), thereby replacing the air with the gas in the interior volume. In implementations, the removing the air includes pulling a vacuum on the interior volume to remove the air. In implementations, the method includes the inhibiting the external air entering the interior volume involving placing a wadding in the EPD, wherein the EPD is a perforating gun. In implementations, the wellbore includes a casing, wherein forming the perforation includes forming the perforation in the casing. In implementations, the EPD includes a perforating gun, a capsule gun, or a jet cutter.

In view of the foregoing, the present disclosure may provide EPD for deployment to form a perforation in a wellbore in which, the methods, systems, and tools may include any of the various features disclosed herein, including one or more of the following statements.

Statement 1. A method of deploying an energetic perforating device having an explosive into a wellbore, the method comprising: removing air from an interior volume of the energetic perforating device, wherein the energetic perforating device comprises a perforating gun, a capsule gun, or a jet cutter; placing the energetic perforating device into the wellbore, wherein the wellbore is in a subterranean formation; and forming a perforation in the wellbore with the energetic perforating device by detonating the explosive, wherein the removing of the air limits reaction of the explosive, thereby limiting production of heat due to the reaction.

Statement 2. The method of Statement 1, wherein removing the air from the energetic perforating device comprises displacing the air by purging the energetic perforating device with an inert gas, thereby replacing the air with the inert gas.

Statement 3. The method of any preceding Statement, wherein removing the air from the energetic perforating device comprises pulling a vacuum on the interior volume of the energetic perforating device to remove the air.

Statement 4. The method of any preceding Statement, wherein the removing of the air limits the reaction to heat of explosion, thereby limiting pressure in the energetic perforating device caused by the reaction.

Statement 5. The method of any preceding Statement, wherein the removing of the air limits the reaction to below heat of combustion.

Statement 6. The method of any preceding Statement, wherein the removing of the air limits reduces oxygen in the energetic perforating device, thereby reducing pressure in the energetic perforating device caused by the reaction.

Statement 7. The method of any preceding Statement, wherein the removing of the air limits the reaction due to the removing of the air causing a deficiency of oxygen ($O_2$) in the energetic perforating device for the reaction, wherein a reaction product of the reaction is carbon monoxide (CO), and wherein forming the perforation in the wellbore comprises forming multiple perforations in the wellbore.

Statement 8. The method of any preceding Statement, wherein the wellbore comprises a casing, and wherein forming the perforation comprises forming the perforation in the casing.

Statement 9. A method of deploying an energetic perforating device having an explosive into a wellbore, the method comprising: removing air from an interior volume of the energetic perforating device; placing the energetic perforating device into the wellbore, wherein the wellbore is in a subterranean formation, and wherein the energetic perforating device comprises a perforating gun, a capsule gun, or a jet cutter; and forming a perforation in the wellbore with the energetic perforating device by detonating the explosive, wherein the removing the air limits reaction of the explosive, thereby limiting production of carbon dioxide in the energetic perforating device caused by the reaction.

Statement 10. The method of Statement 9, wherein the explosive comprises pentaerythritol tetranitrate (PETN), royal demolition explosive (RDX), high melting explosive (HMX), hexanitrostilbene (HNS), or 2,6-bis(picrylamino)-3,5-dinitropyridine (PYX), or any combinations thereof.

Statement 11. The method of Statement 9 or Statement 10, wherein removing the air from the energetic perforating device comprises utilizing a vacuum to remove the air.

Statement 12. The method of Statements 9-11, wherein the removing of the air from the energetic perforating device comprises replacing the air with an inert gas.

Statement 13. The method of Statement 12, wherein the inert gas comprises nitrogen, argon, or helium, or any combinations thereof.

Statement 14. The method of Statements 9-13, wherein a product of the reaction comprises solid elemental carbon.

Statement 15. A method of deploying an energetic perforating device having an explosive into a wellbore, the method comprising: removing air from an interior volume of the energetic perforating device or inhibiting external air entering the interior volume, or a combination thereof; placing the energetic perforating device into the wellbore; and forming a perforation in the wellbore with the energetic perforating device by detonating the explosive, wherein the removing the air or the inhibiting the external air, or the combination thereof, limits reaction of the explosive.

Statement 16. The method of Statement 15, comprising the removing the air comprising displacing the air by purging the energetic perforating device with a gas having less than 5 weight percent (wt %) of oxygen ($O_2$), thereby replacing the air with the gas in the interior volume.

Statement 17. The method of Statement 15 or Statement 16, comprising the removing the air comprising pulling a vacuum on the interior volume to remove the air.

Statement 18. The method of Statements 15-17, comprising the inhibiting the external air entering the interior volume comprising placing a wadding in the energetic perforating device, wherein the energetic perforating device comprises a perforating gun.

Statement 19. The method of Statements 15-18, wherein the wellbore comprises a casing, wherein forming the perforation comprises forming the perforation in the casing, wherein the removing the air or the inhibiting the external air, or the combination thereof, thereby limiting the reaction reduces an amount of carbon dioxide produced by the reaction and reduces heat produced by the reaction.

Statement 20. The method of Statements 15-19, wherein the energetic perforating device comprises a perforating gun, a capsule gun, or a jet cutter.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

The present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method of deploying an energetic perforating device having an explosive into a wellbore, the method comprising:

placing wadding in an interior volume of the energetic perforating device, wherein the energetic perforating device comprises a perforating gun, a capsule gun, or a jet cutter;

removing air from the interior volume;

placing the energetic perforating device into the wellbore, wherein the wellbore is in a subterranean formation; and forming a perforation in the wellbore with the energetic perforating device by detonating the explosive, wherein the removing of the air limits reaction of the explosive, thereby limiting production of heat due to the reaction.

2. The method of claim 1, wherein removing the air from the energetic perforating device comprises displacing the air by purging the energetic perforating device with an inert gas, thereby replacing the air with the inert gas.

3. The method of claim 1, wherein removing the air from the energetic perforating device comprises pulling a vacuum on the interior volume of the energetic perforating device to remove the air.

4. The method of claim 1, wherein the removing of the air limits the reaction to heat of explosion, thereby limiting pressure in the energetic perforating device caused by the reaction.

5. The method of claim 1, wherein the removing of the air limits the reaction to below heat of combustion.

6. The method of claim 1, wherein the removing of the air limits reduces oxygen in the energetic perforating device, thereby reducing pressure in the energetic perforating device caused by the reaction.

7. The method of claim 1, wherein the removing of the air limits the reaction due to the removing of the air causing a deficiency of oxygen ($O_2$) in the energetic perforating device for the reaction, wherein a reaction product of the reaction is carbon monoxide (CO), and wherein forming the perforation in the wellbore comprises forming multiple perforations in the wellbore.

8. The method of claim 1, wherein the wellbore comprises a casing, and wherein forming the perforation comprises forming the perforation in the casing.

9. A method of deploying an energetic perforating device having an explosive into a wellbore, the method comprising:

removing air from an interior volume of the energetic perforating device using an oxygen scavenger, placing the energetic perforating device into the wellbore, wherein the wellbore is in a subterranean formation, and wherein the energetic perforating device comprises a perforating gun, a capsule gun, or a jet cutter; and forming a perforation in the wellbore with the energetic perforating device by detonating the explosive, wherein the removing the air limits reaction of the explosive, thereby limiting production of carbon dioxide in the energetic perforating device caused by the reaction.

10. The method of claim 9, wherein the explosive comprises pentaerythritol tetranitrate (PETN), royal demolition explosive (RDX), high melting explosive (HMX), hexanitrostilbene (HNS), or 2,6-bis(picrylamino)-3,5-dinitropyridine (PYX), or any combinations thereof.

11. The method of claim 9, wherein removing the air from the energetic perforating device comprises utilizing a vacuum to remove the air.

12. The method of claim 9, wherein the removing of the air from the energetic perforating device comprises replacing the air with an inert gas.

13. The method of claim 12, wherein the inert gas comprises nitrogen, argon, or helium, or any combinations thereof.

14. The method of claim 9, wherein a product of the reaction comprises solid elemental carbon.

15. A method of deploying an energetic perforating device having an explosive into a wellbore, the method comprising:

removing air from an interior volume of the energetic perforating device using an oxygen absorbing component in the interior volume;

placing the energetic perforating device into the wellbore; and forming a perforation in the wellbore with the energetic perforating device by detonating the explosive, wherein the removing the air or the inhibiting the external air, or the combination thereof, limits reaction of the explosive.

16. The method of claim 15, comprising the removing the air comprising displacing the air by purging the energetic perforating device with a gas having less than 5 weight percent (wt %) of oxygen ($O_2$), thereby replacing the air with the gas in the interior volume.

17. The method of claim 15, comprising the removing the air comprising pulling a vacuum on the interior volume to remove the air.

18. The method of claim 15, comprising the inhibiting the external air entering the interior volume comprising placing a wadding in the energetic perforating device, wherein the energetic perforating device comprises a perforating gun.

19. The method of claim 15, wherein the wellbore comprises a casing, wherein forming the perforation comprises forming the perforation in the casing, wherein the removing the air or the inhibiting the external air, or the combination thereof, thereby limiting the reaction reduces an amount of carbon dioxide produced by the reaction and reduces heat produced by the reaction.

20. The method of claim 15, wherein the energetic perforating device comprises a perforating gun, a capsule gun, or a jet cutter.

* * * * *